US005195468A

United States Patent [19]

Clark et al.

[11] Patent Number: 5,195,468

[45] Date of Patent: Mar. 23, 1993

[54] CYLINDER HEAD COOLING SYSTEM

[76] Inventors: Richard J. Clark, R.R. 1, Box 155; Richard K. Clark, 317 E. Second, both of Gilman, Ill. 60938; Dennis E. Clark, 809 S. Poplar, Onarga, Ill. 60955

[21] Appl. No.: 953,498

[22] Filed: Sep. 29, 1992

[51] Int. Cl.[5] ..... F02F 1/36

[52] U.S. Cl. ..... 123/41.82 R

[58] Field of Search ..... 123/41.82 R

[56] References Cited

U.S. PATENT DOCUMENTS 3,315,652 4/1967 Ries et al. ..... 123/41.82 R

*Primary Examiner*—Noah P. Kamen

*Attorney, Agent, or Firm*—Kajane McManus

[57] ABSTRACT

The improved outlet end cooling system for a cylinder head of a locomotive engine includes a modified water pathway in the cylinder head, an outlet therefrom exiting from an upwardly directed surface of the cylinder head, and further including a modified rocker arm support having a planar bottom support surface and having an inlet port therein which is engageable with an outlet port in the cylinder head. The support has a water pathway therein which terminates in a nipple, the nipple extending past the cylinder head and downwardly along a side wall of the cylinder head into engagement with a remaining portion of the waterway. The improved outlet end allows for equal thickness of the side wall around the entire extent thereof, and eliminates a temperature gradient in an area of the cylinder head underlying a crab plate engaged thereover, virtually eliminating cracking and extending the useful life of the cylinder head.

11 Claims, 7 Drawing Sheets

FIGURE 5
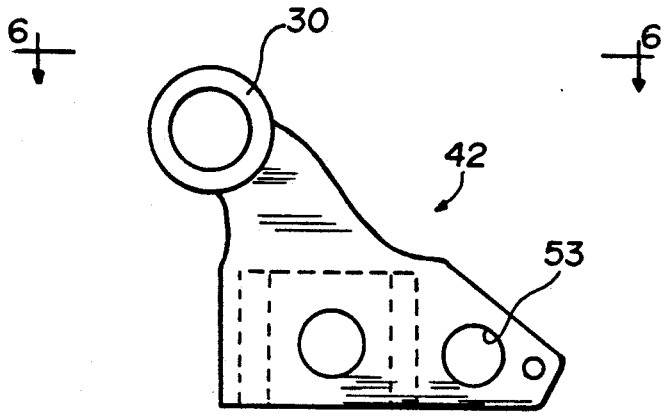
FIGURE 6
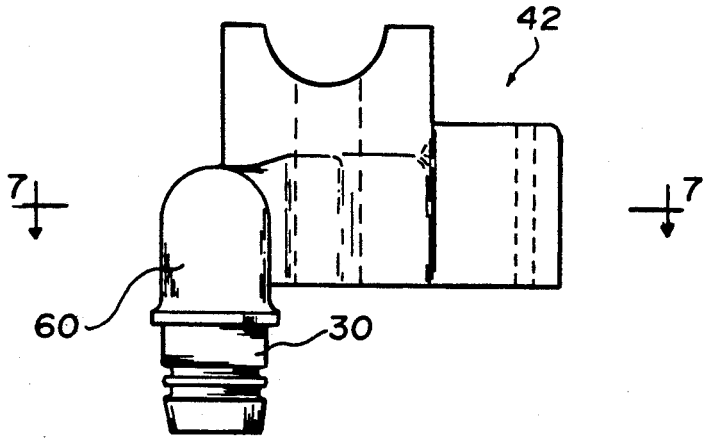
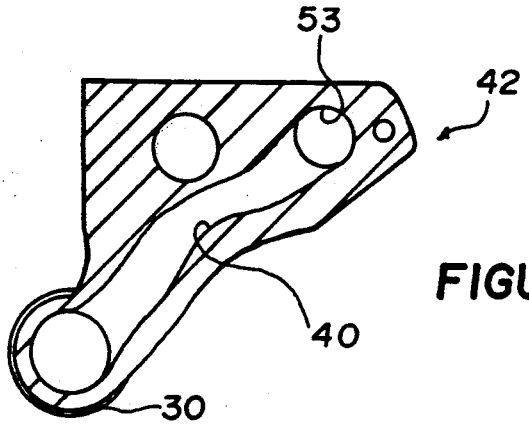
FIGURE 7

CYLINDER HEAD COOLING SYSTEM

BACKGROUND OF THE INVENTION

The present invention relates to an improved cylinder head cooling system for use in a locomotive engine. More particularly, the cooling system includes an outlet path which keeps the cylinder head from cracking near the outlet therefrom by moving the outlet into a rocker arm support mounted on the cylinder head.

PRIOR ART

Heretofore the cooling system for a cylinder head of a locomotive engine has included an outlet path having a portion thereof underlying a finger of a crab plate used to hold the cylinder head in place. This configuration has caused a temperature gradient across the area of the cylinder head underlying the crab plate, with vibration against the crab plate causing the cylinder head to crack near the water outlet therefrom. At the outlet from the pathway, an outlet nipple has been provided which engages within a cooperating notch formed in a side wall of the cylinder head, thinning the side wall significantly. This notch is also contiguous to the area of the cylinder head underlying the crab plate, producing a further weakness in the stressed area which contributes to the cracking of the cylinder head in the area of the outlet.

As will be described in greater detail hereinafter, the improved cooling system of the present invention virtually eliminates cracking of the cylinder head in the area underlying the crab plate by moving the outlet path radially inwardly, away from the area engaged beneath the crab plate.

SUMMARY OF THE INVENTION

According to the invention there is provided an improved cooling system for the cylinder head of a locomotive engine, the system including an outlet path which avoids peripheral areas of the cylinder head underlying a crab plate which holds the cylinder head in place, the path extending about the interior of the head and emptying via a non-peripheral port located adjacent a rocker arm support engaged to the cylinder head on an upwardly directed surface thereof, the rocker arm support including a pathway therethrough, one end of which engages the non-peripheral port in the cylinder head and another end of which terminates in an outlet nipple.

BRIEF DESCRIPTION OF THE DRAWINGS

FIG. 5 is a bottom plan view of the rocker arm support.

FIG. 6 is a side view of the rocker arm support.

FIG. 7 is a sectional view through the rocker arm support showing the outlet flow path therethrough.

DESCRIPTION OF THE PREFERRED EMBODIMENT

Figure 1:
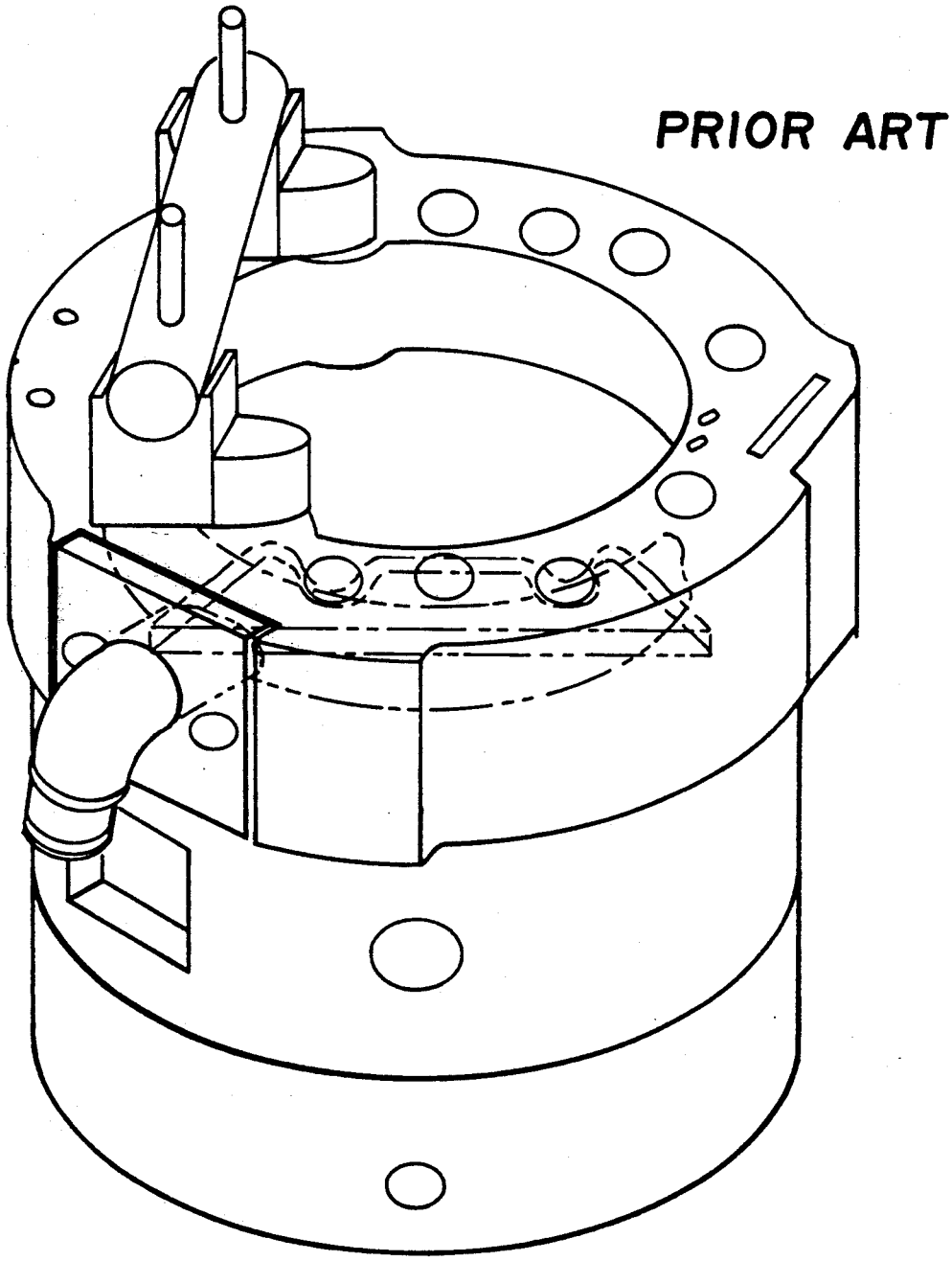
FIG. 1 is a perspective view of a cylinder head incorporating a prior art outlet end of a cylinder head cooling system for a locomotive engine.
Figure 2:
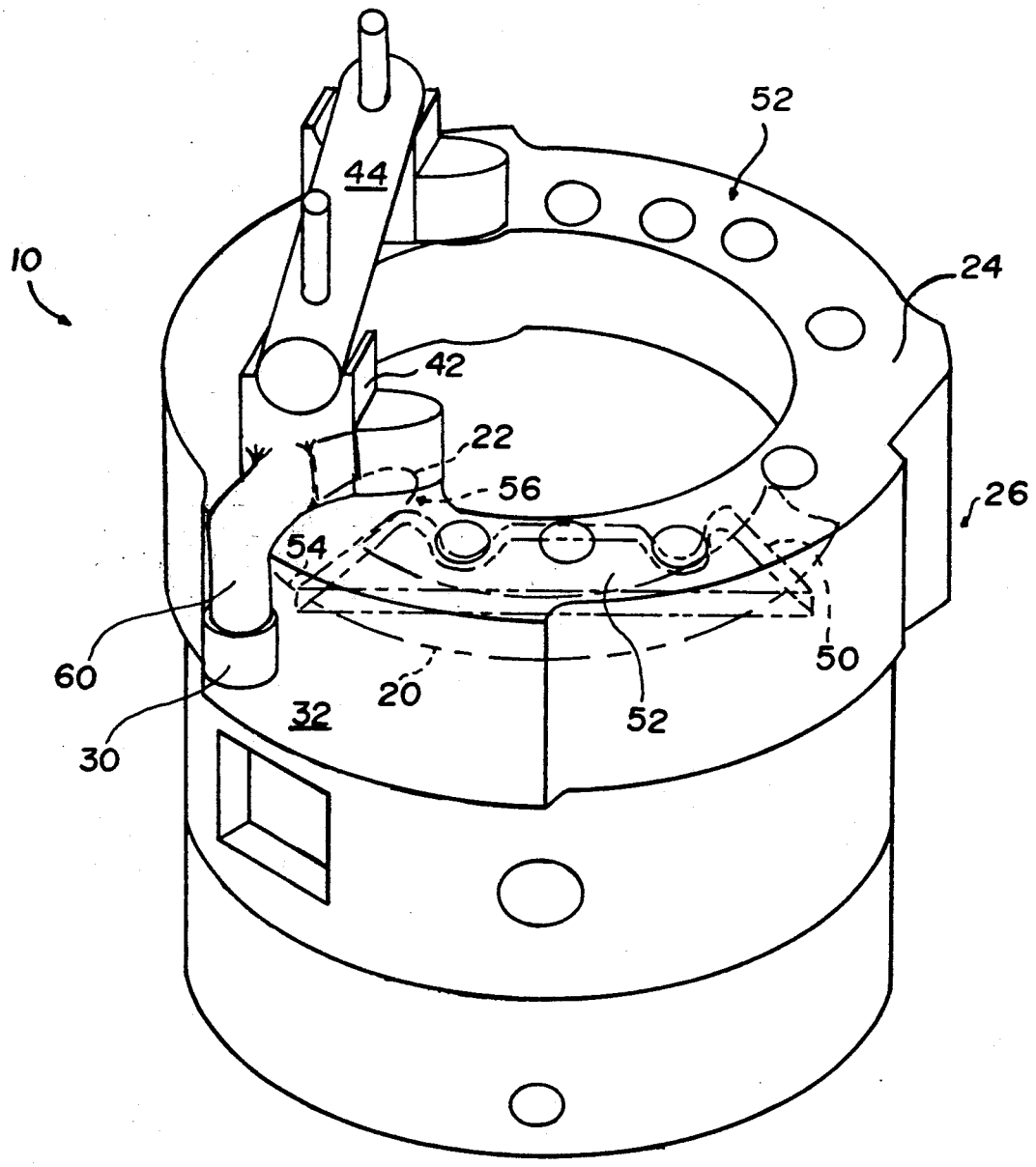
FIG. 2 is a perspective view of a first primary embodiment of an improved outlet end for a cylinder head cooling system.
Figure 3:
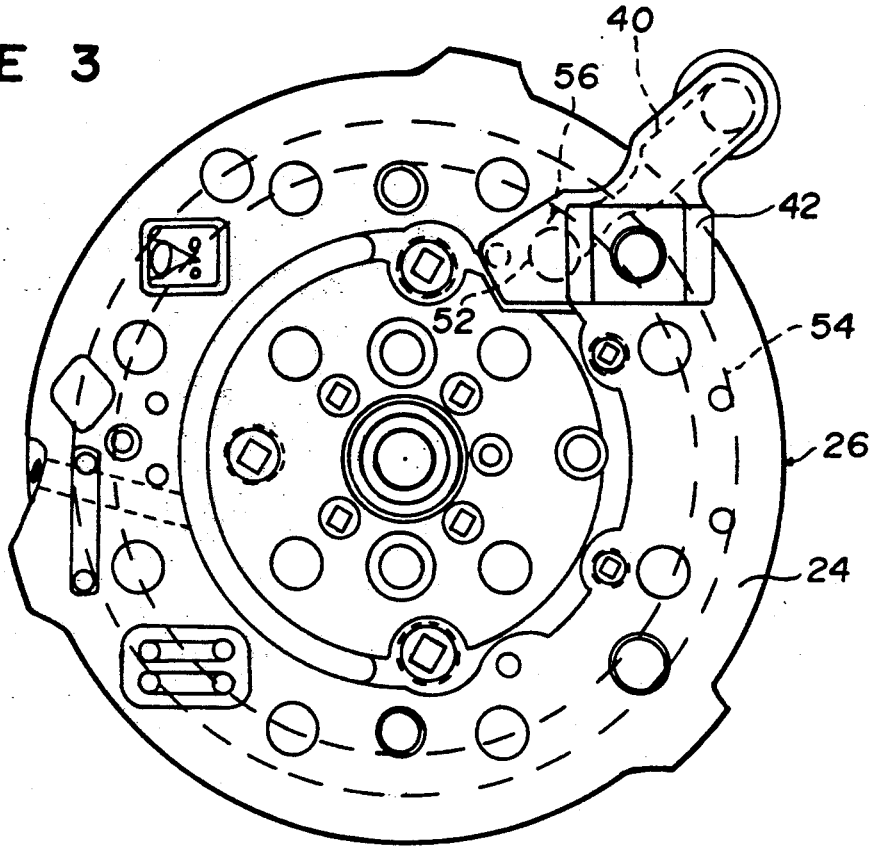
FIG. 3 is a top view of the cylinder head incorporating the improved outlet end cooling system of the present invention and showing the flow path therethrough in phantom.
Figure 4:
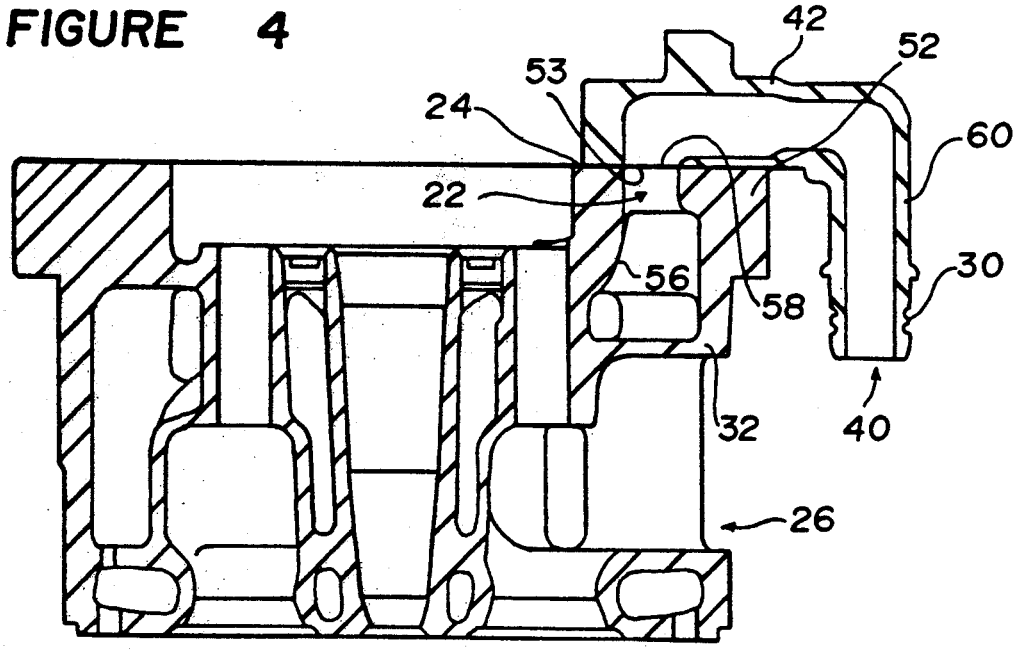
FIG. 4 is a cross sectional view through a portion of the cylinder head incorporating the rocker arm support forming the improved outlet end cooling system.
Figure 8:
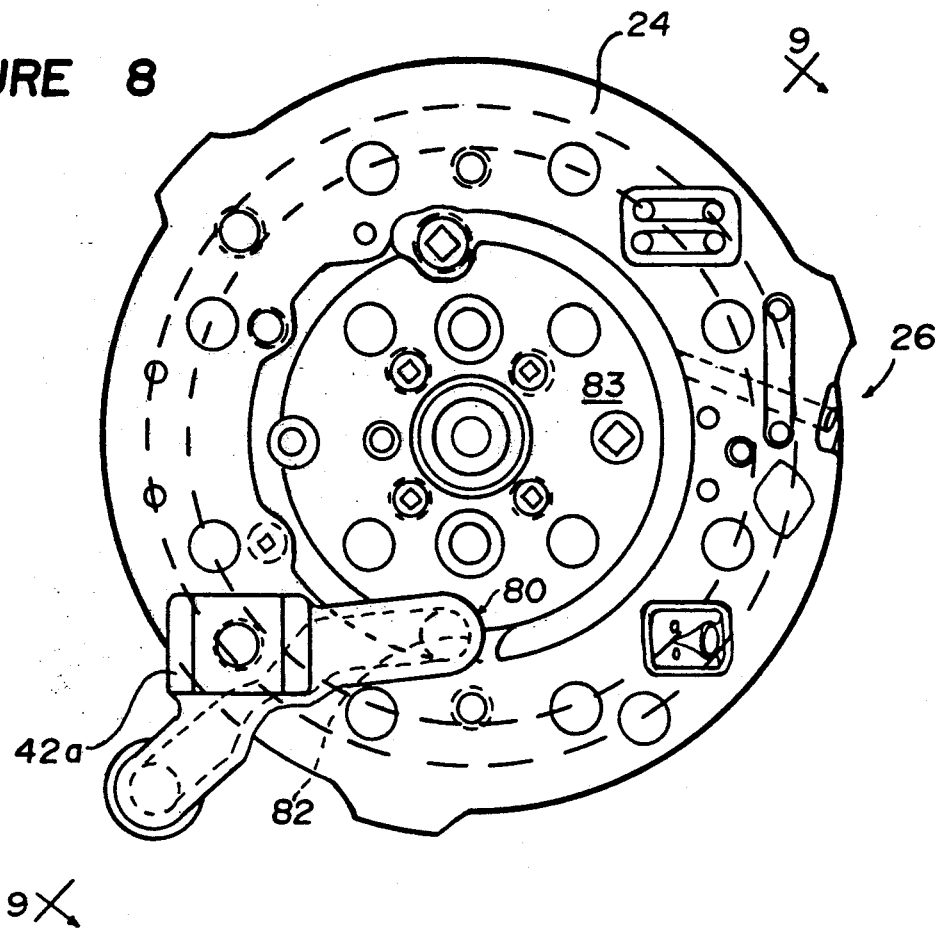
FIG. 8 is a top view of a secondary embodiment of the modified outlet end wherein the inlet into the rocker arm support is further modified.
Figure 9:
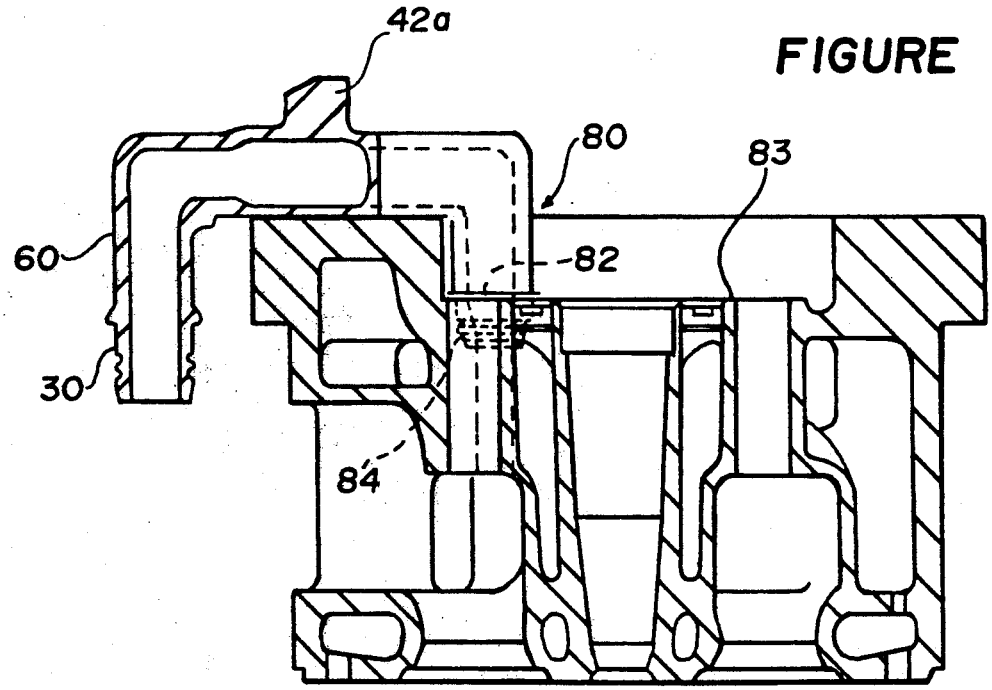
FIG. 9 is a cross sectional view through the embodiment of FIG. 8.
Figure 10:
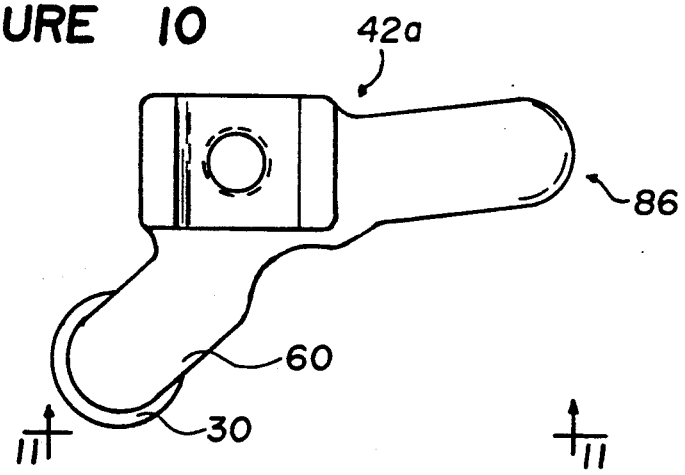
FIG. 10 is a top plan view of the rocker arm support of FIG. 8.
Figure 11:
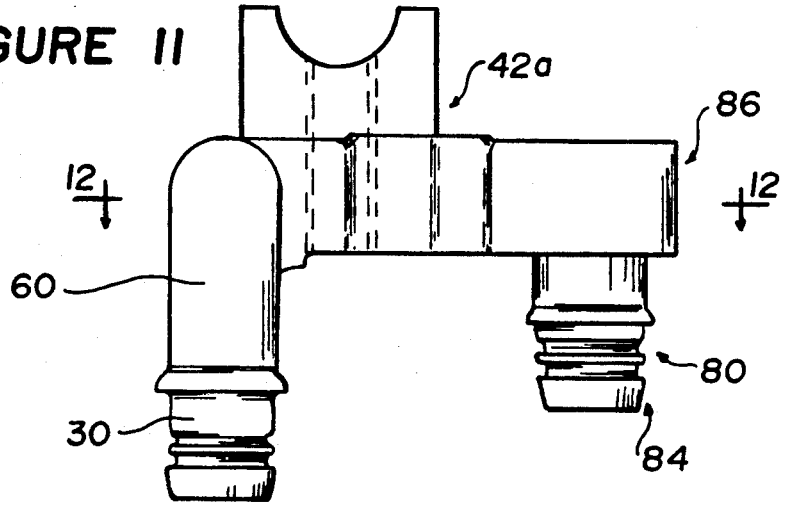
FIG. 11 is a side view of the rocker arm support of FIG. 10.
Figure 12:
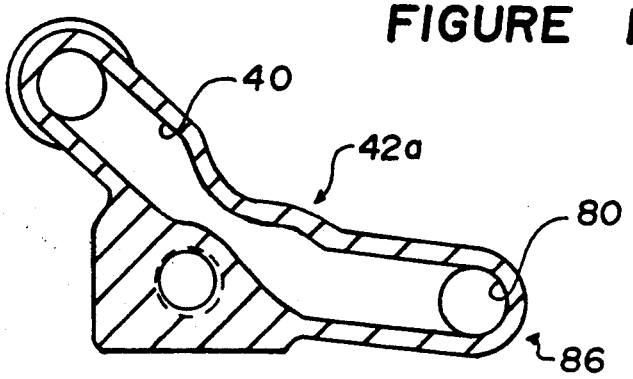
FIG. 12 is a cross sectional view through the rocker arm support of FIG. 11 showing the water path therethrough.

Referring now to the drawings in greater detail, there is illustrated in FIG. 1 the prior art cylinder head cooling system for a locomotive engine.

As partially shown in phantom, the cylinder head has a pathway therewithin by means of which water is circulated through the cylinder head to maintain same cool. The flow path, immediately prior to reaching an outlet from the cylinder head, travels beneath a portion of a crab plate, used to maintain position of the cylinder head, and, upon reaching the outlet, exits via an outlet nipple which is a separate structure including a base plate. The base plate of the outlet nipple seats within an undercut area provided in a side wall of the cylinder head, adjacent the area of the cylinder head underlying the crab plate.

As water passes through this outlet area, it creates a temperature differential in the thinned material of the cylinder head lying between the pathway and the crab plate. Further, because of the undercut area in the side wall adjacent the pathway underlying the crab plate, the material of the cylinder head in this area is thinner in the transverse plane as well, making it more easily stressed.

The combination of the temperature differential and the stress created by the crab plate engagement causes the cylinder head to crack in the area underlying the crab plate and overlying the water pathway, shortening the useful life of the cylinder head.

The improved outlet end cylinder head cooling system 10 of the present invention virtually eliminates such potential cracking.

In this respect, the system 10 first includes an altered water flow path 20, an outlet 22 of which exits, in a first embodiment, from a top surface 24 of a cylinder head 26.

Inasmuch as the water must ultimately return to a reservoir (not shown) for same, an outlet nipple 30, which mimics that previously provided in position and delivery, must be created.

To accomplish this goal, while at the same time allowing a side wall 32 of the cylinder head 26 to be thickened into conformity with the thickness dimension of the remainder of the side wall 32 of the cylinder head 26, this embodiment proposes that an outlet flow path 40 (FIGS. 3–7) be created within a rocker arm support 42 which engages against the top surface 24 of the cylinder head 26 to support a rocker arm 44 thereabove. Extending the outlet flow path 40 through the rocker arm support 42 eliminates the need for a pathway beneath a crab plate 50 which overlies opposed peripheral lateral areas 52 of the top surface 24 of the cylinder head 26.

As stated above, the outlet nipple 30 from this flow path 20 must terminate at a position where engagement to the remainder of the engine water path (not shown) is possible. Thus, an elongate nipple connector 60 is provided as a unitary part of the rocker arm support 42, extending to a position where the nipple 30 must be located.

The downwardly extending nipple 30 depending from the connector 60 must be elongated to terminate at a position substantially similar to that of the prior art.

By eliminating the need for the separate nipple and side wall mounted base plate thereof of the prior art, the thickness of the side wall 32 of the cylinder head 26 may remain constant rather than being thinned, so the side wall 32 in the area engaged by the crab plate 50 can accommodate greater levels of stress.

As stated above, the water flow path 22 in the cylinder head 26 has been modified to accommodate the new position of an inlet 53 to the water pathway 40 in the rocker arm support 42.

First of all, since no peripheral outlet is needed, a radially outer surface 54 of the pathway 40 is now uninterrupted, continuing around the periphery of the cylinder head 26.

Secondly, a radially inward jog must be created, at 56, to accommodate relative engagement with the inlet 53 in the rocker arm support 42.

The jog at 56 terminating in an outlet 58 in the cylinder head 26, can be created in any known manner, and can be joined with the inlet 52 in known, fluid tight manner.

For example, although not shown, an O-ring could be compressed between the cylinder head 26 and the support 42 to assure no leakage therebetween.

With this configuration of the outlet flow path 40, cracking of the cylinder head 26 in the area under the crab plate 50 is virtually eliminated, extending the useful life of the cylinder head 26 significantly.

Alternatively, so long as the thickness of the material of the cylinder head 26 is not compromised in the area seated below the crab plate 50, other embodiments could be proposed for the outlet flow path 40.

For example, in FIGS. 8-12, engagement of a fluid pathway inlet 80 into a rocker arm support 42*a* is provided directly via an existing plugged opening 82 leading to the water pathway 20 within the cylinder head 26, the opening being present in a recessed center upwardly facing surface 83 of the cylinder head.

Here, a plug (not shown) engaged within the opening 82 is removed and an inlet nipple 84 provided on an inlet end 86 of modified rocker arm support 42*a* is engaged in a fluid tight manner within the opening 82. Water flow enters the inlet 80, travels through the inlet nipple 84 and then proceeds through the rocker arm support 42*a* in the fashion described above.

Figure 13:
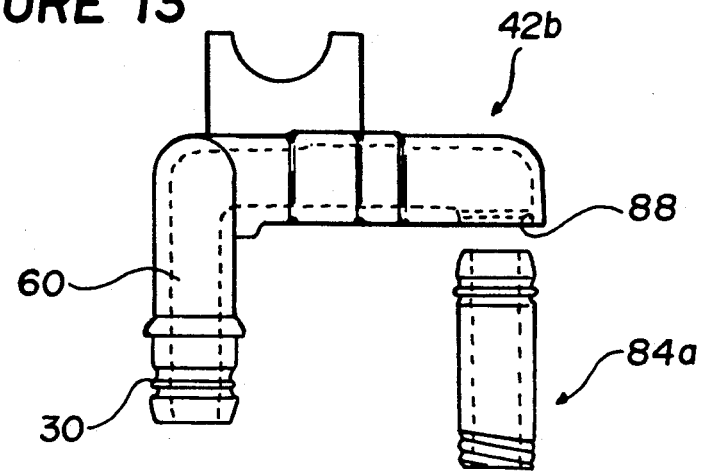
FIG. 13 is a side view of an alternative embodiment for the rocker arm of FIG. 11.
Figure 14:
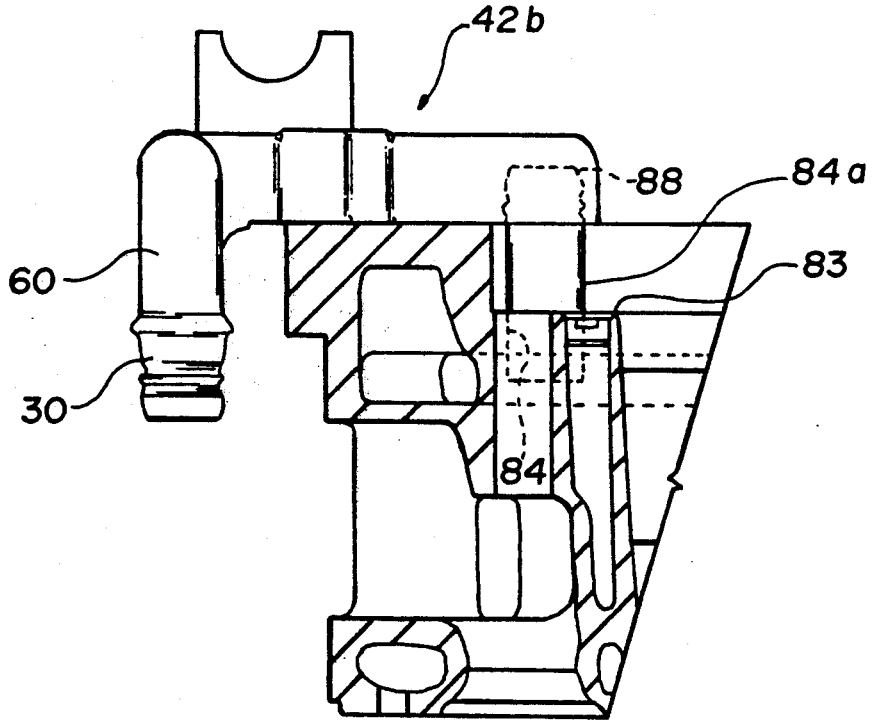
FIG. 14 is a cross sectional view through the rocker arm support of FIG. 13 and of the area of the cylinder head therebeneath.

In FIGS. 8-12, a unitary inlet nipple 84 is proposed. However, as shown in FIGS. 13 and 14, a nipple 84*a* may be provided as a separate entity.

As illustrated, the inlet nipple 84*a* is a double male end tube 84*a*, which includes structure thereon for creating a fluid tight seal with an opening 88 in a rocker arm support 42*b*, as well as creating a fluid tight seal within the opening 84 in the cylinder head 26.

With respect to creating a fluid tight seal between the elements, such can be created in any known fashion, including the fashions best illustrated in FIGS. 9, 11, 13 and 14.

By providing these alternate embodiments, any required connection may be accommodated.

As described above, the improved outlet end water path for a cylinder head of a locomotive engine has a number of advantages, some of which have been described above and others of which are inherent in the invention. Also, modifications can be proposed to the system 10 without departing from the teachings herein.

Accordingly the scope of the invention need only be limited as necessitated by the accompanying claims.

We claim:

1. An improved cooling system for a cylinder head of a locomotive engine, the improvement residing in the configuration of an outlet end thereof, and comprising:
   - a full thickness side wall about a periphery of said cylinder head;
   - an outlet port extending from a fluid flow path within said cylinder head radially inwardly to an upwardly directed surface of said cylinder head;
   - a rocker arm support including a planar bottom support surface and an arcuate upper surface for supporting a rocker arm thereon;
   - said rocker arm support including a port therein leading to a passageway within said support, said passageway creating a continuation of said outlet in said cylinder head and said port in said support aligning with said port in said cylinder head, said support further including a nipple formation thereon forming a termination for said pathway therethrough, said nipple formation extending past a peripheral end edge of said cylinder head top surface and then downwardly to a predetermined level along the side wall of said cylinder head to a preselected position.

2. The system of claim 1 wherein said outlet port of said cylinder head is bored into a non peripheral area thereof.

3. The system of claim 2 wherein said non peripheral area is on a top surface of said cylinder head.

4. The system of claim 1 wherein said outlet port of said cylinder head is situated on an upwardly facing central surface of said cylinder head which is recessed below a top surface thereof.

5. The system of claim 4 wherein said rocker arm support includes an inlet nipple which engages within said recessed outlet port.

6. The system of claim 5 wherein said inlet nipple is unitary with said rocker arm support.

7. The system of claim 5 wherein said inlet nipple is a tubular structure, one end of which engages within said recessed outlet port in said cylinder head and another end of which engages within said inlet port in said rocker arm support.

8. The system of claim 7 wherein said inlet nipple is double male ended, with each end sealingly engaging within a respective port.

9. The system of claim 8 wherein said male ends are threaded.

10. The system of claim 8 wherein said male ends are press fitted into said respective ports.

11. An improved cooling system for a locomotive cylinder head wherein a rocker arm support is mounted to the cylinder head, the improvement comprising a modified outlet water path wherein said path exits an upwardly directed surface of said cylinder head at a non peripheral point therealong and has a continuation thereof formed in a base portion of said rocker arm support, said continuation terminating in an outlet nipple extending downwardly adjacent a side wall of said cylinder head, thereby avoiding compromise of the thickness of peripheral areas of said cylinder head.

* * * * *